US012778271B2

(12) United States Patent
Zhang et al.

(10) Patent No.: US 12,778,271 B2
(45) Date of Patent: Nov. 3, 2026

(54) OUTDOOR WATER CUP

(71) Applicant: Heenoor Co., Ltd, Nantong (CN)

(72) Inventors: Yuanjijia Zhang, Nantong (CN); Poquan Chen, Nantong (CN); Wenfeng Wu, Nantong (CN); Qian Chen, Nantong (CN)

(73) Assignee: Heenoor Co., Ltd, Nantong (CN)

( * ) Notice: Subject to any disclaimer, the term of this patent is extended or adjusted under 35 U.S.C. 154(b) by 133 days.

(21) Appl. No.: 18/961,546

(22) Filed: Nov. 27, 2024

(65) Prior Publication Data

US 2026/0033618 A1 Feb. 5, 2026

(30) Foreign Application Priority Data

Aug. 2, 2024 (CN) ..... 202411059668.3

(51) Int. Cl.
*A45F 3/18* (2006.01)

(52) U.S. Cl.
CPC ..... *A45F 3/18* (2013.01)

(58) Field of Classification Search
CPC ..... A45F 3/18; B65D 21/086; B65D 25/24; B65D 2519/00273; B65D 25/06; B65D 25/20
USPC ..... 220/629, 17.3
See application file for complete search history.

(56) References Cited

U.S. PATENT DOCUMENTS 7,350,671 B2 * 4/2008 Mika ..... B67D 3/0009 222/129
8,172,077 B1 * 5/2012 Gray ..... B25H 1/04 190/18 R
8,181,811 B1 * 5/2012 Blake ..... A45B 23/00 248/156
2015/0321793 A1 * 11/2015 Oved ..... B65D 21/086 215/395

* cited by examiner

*Primary Examiner* — Orlando E Aviles
*Assistant Examiner* — Sanjidul Islam
(74) *Attorney, Agent, or Firm* — Cooper Legal Group, LLC

(57) ABSTRACT

The present application discloses an outdoor water cup, including a base, a cup body, and a cup lid, the cup body is located on the base, a sliding ring is slidably provided on the cup body, a plurality of protective frames are rotatably provided on a side wall of the sliding ring, a linkage rod is provided between the protective frame and the base, a tension spring is provided on the linkage rod; a surface of the protective frame is defined with a limiting groove, a plurality of limiting blocks configured for lifting and lowering are provided on the base, and a lifting assembly is provided on the base. The present application has an effect of making the water cup adapt to different outdoor terrains, stabilizing the water cup on outdoor terrains, reducing the occurrence of damage to the water cup, and improving the functionality of the water cup.

9 Claims, 4 Drawing Sheets

OUTDOOR WATER CUP

CROSS-REFERENCE TO RELATED APPLICATION

The present application is based on and claims the priority benefits of China application No. 202411059668.3, filed on Aug. 2, 2024. The entirety of China application No. 202411059668.3 is hereby incorporated by reference herein and made a part of this specification.

TECHNICAL FIELD

The present application relates to a technical field of water cups, and, more particularly, to an outdoor water cup.

BACKGROUND ART

A water cup is a specialized container for holding water, mainly used for drinking water, with a continuous development of social economy, more and more people enjoy outdoor activities and experience a scenery of nature, during outdoor activities, the water cup is an indispensable tool.

There is a glass cup designed in related technology, which is cylindrical in shape as a whole. However, this type of water cup is prone to damage when used outdoors, when placed outdoors, due to complex outdoor terrains and small bottom area of the water cup, the glass cup cannot adapt to outdoor terrains. Therefore, the glass cup is prone to tipping over and getting damaged when placed outdoors, and thus there is a need for improvement.

SUMMARY

In order to make the water cup adapt to different outdoor terrains and stabilize the water cup on the outdoor terrain to reduce an occurrence of damage to the water cup and improve a functionality of the water cup, the present application provides an outdoor water cup.

The outdoor water cup provided in the present application adopts the following technical solution.

An outdoor water cup, including a base, a cup body and a cup lid, wherein the cup body is located on the base, the cup lid is located on the cup body; a sliding ring is slidably provided on the cup body, a plurality of protective frames are rotatably provided on a side wall of the sliding ring, a linkage rod is provided between the protective frame and the base, a first end of the linkage rod is hinged to the protective frame, a second end of the linkage rod is hinged to the base; a tension spring is provided on the linkage rod, a first end of the tension spring is connected to the linkage rod, a second end of the tension spring is connected to the protective frame; a surface of the protective frame is defined with a limiting groove, a plurality of limiting blocks configured for lifting and lowering are provided on the base, the limiting block is configured to inserted into the limiting groove to abuts against the limiting groove; a lifting assembly is provided on the base and configured to drive the plurality of limiting blocks to lift and lower simultaneously.

By adopting the above technical solution, when the water cup is in use, the limiting block is inserted into the limiting groove, and the limiting block abuts against the protective frame, so that the protective frame is vertically between the sliding ring and the base, the protective frame is also located around the cup body, and the plurality of protective frames form a circle to protect the cup body and reduce damage to the cup body during use. When the water cup is placed outdoors, the lifting assembly can be utilized to drive the plurality of limiting blocks to lift and lower simultaneously, causing the limiting blocks to slide into the base, the limiting block will detach from the limiting groove. At this time, the tension spring pulls the protective frame, the second end of the linkage rod rotates with the base, and the first end of the linkage rod rotates with the protective frame, the tension spring contracts to pull the sliding ring to slide on the cup body towards a direction of the base, the sliding ring descends and drives the protective frame to rotate, causing the plurality of protective frames to simultaneously rotate and tilt on the side wall of the sliding ring. At this time, a lowest end of the protective frame is lower than the base, utilizing the protective frame to support the water cup. The protective frame can increase a support area of the water cup, thereby allowing the water cup to be stably placed on outdoor terrains and adapt to different outdoor terrains, the protective frame can not only protect the cup body but also support the cup body, reducing the occurrence of damage to the water cup and improving the functionality of the water cup.

In some embodiments, the lifting assembly includes a button, a guiding column, a protrusion, a rotating block, a limiting column and a reset element, the limiting column is fixedly provided inside the base, the limiting block is slidably provided on the limiting column, a plurality of the guiding columns are fixedly provided inside the base, a lower surface of the base is defined with a driving groove, the button is slidably provided on the guiding column and penetrates the driving groove, the protrusion is integrated on an end wall of the button, the rotating block is rotatably provided inside the base, the protrusion is configured to abut against a first end of the rotating block, the limiting block is defined with a contacting groove for inserting and abutting against a second end of the rotating block; the reset element is located inside the base, and the reset element is configured to drive the button and the limiting block to reset.

By adopting the above technical solution, when the protective frames are needed to support the water cup, the button is pressed and slides along a height direction of the base on the guiding column. When the button slides, a plurality of protrusions are driven to slide, and the protrusion abuts against the first end of the rotating block, which drives the rotating block to rotate inside the base, the rotating block continues to rotate until the rotating block is inserted into the contacting groove and contacts an inner wall of the contacting groove. The rotating block presses the contacting groove with a contact force, which drives the limiting block to slide towards a bottom wall of the base on the limiting column, the limiting block gradually retracts into the base, and can quickly detach from the limiting groove. When the button is released, the reset element can drive the button and the limiting block to reset, an operation is convenient and fast.

In some embodiments, the reset element includes a first reset spring and a second reset spring, the first reset spring is sleeved on the limiting column and abuts against the limiting block, the second reset spring is provided on a top wall of the base and abuts against the button, the second reset spring is configured to the button to be located in the driving groove; a surface of the limiting block is inclined and defined with a first guiding surface, and the protective frame is configured to abut against the first guiding surface.

By adopting the above technical solution, after releasing the button, the first reset spring drives the limiting block to slide away from the bottom wall of the base, and the limiting block slides out of the base, the second reset spring drives the button to slide towards the bottom wall of the base, so that the button is located in the driving groove at a bottom end of the base. When there is no need to use the protective frames to support the cup body, press the protective frame and bring the protective frame close to the cup body. The protective frame can abut against the first guiding surface, driving the limiting block to automatically retract into the base. The reset element then drives the limiting block to be inserted into the limiting groove, which is conducive to improving a convenience of using the water cup.

In some embodiments, an inner wall of the cup lid is in contact with a cup lip of the cup body, an outer wall of the cup lid is defined with an external thread, an inner wall of the sliding ring is defined with an internal thread, and the external thread is threaded with the internal thread.

By adopting the above technical solution, when the protective frames are used to support the water cup, a user needs to first rotate the cup lid to separate the external thread and the internal thread from each other, before the protective frame can be rotated. Utilizing a combination of the external thread and the internal thread, the protective frame can be locked to reduce accidental contact, at the same time, the combination of the external thread and the internal thread facilitates a fixation of the cup lid.

In some embodiments, an installation block is provided on the sliding ring, a surface of the installation block is defined with an installation groove, a connecting block is rotatably provided inside the installation groove, and the connecting block is connected to a lifting ring, a set of adsorption elements configured to adsorb to the connecting block are provided on an inner wall of the installation groove; the installation block is detachably connected to the sliding ring.

By adopting the above technical solution, the lifting ring is convenient for users to lift the water cup, when the lifting ring is not needed, the connecting block can be rotated to adsorb to the adsorption elements on the inner wall of the installation groove, so that the lifting ring is in a vertical state, reducing a space occupied by the water cup and improving a beauty of the water cup.

In some embodiments, two ends of the installation block are symmetrically defined with a sliding groove, a sliding rod is provided inside the sliding groove, the sliding rod is connected to a connecting rod, the sliding ring is defined with a connecting groove configured for inserting the connecting rod, a locking block is integrated on the connecting rod, an inner wall of the connecting groove is defined with a locking groove configured for inserting and abutting against the locking block; a locking spring is provided inside the sliding groove to abut against the sliding rod, the locking spring is configured to drive the sliding rod to slide away from the sliding groove; an end wall of the locking block is inclined and defined with a second guiding surface.

By adopting the above technical solution, pressing the sliding rod drives the sliding rod to slide in the sliding groove at the same time, causing two sliding rods to approach each other, and then driving two connecting rods to approach each other in the connecting groove. The connecting rod drives the locking block and the locking groove to detach from each other, at this time, the installation block can be disassembled from the sliding ring, using the lifting ring separately. When installing the lifting ring, the connecting rod is directly inserted into the connecting groove, the second guiding surface will abut against the sliding ring, and a force on the second guiding surface will drive the sliding rod to slide into the sliding groove. When the locking block and the locking groove are flush with each other, the locking spring will drive the sliding rod to slide away from the sliding groove, and automatically drive the locking block to be inserted into the locking groove, the operation is convenient and fast.

In some embodiments, the lifting ring is a mountaineering buckle.

By adopting the above technical solution, the lifting ring can be attached to other tools, which is convenient to hang the water cup and improve the functionality of the water cup.

In some embodiments, an inner wall of the lifting ring is provided with a bottle opener, and an outer wall of the lifting ring is provided with a magnetic element.

By adopting the above technical solution, after removing the installation block, the lifting ring and the bottle opener can be utilized to open a bottle with a bottle cap, further improving the functionality of the water cup, the magnetic element can remove the lifting ring and attach the lifting ring to a metal plate on a refrigerator or protective frame, which is convenient to use the lifting ring separately.

In some embodiments, a metal plate is provided on the protective frame, and the metal plate is detachably connected to the protective frame through clamping.

By adopting the above technical solution, the metal plate is customized by DIY, and then the metal plate and the protective frame are connected to each other through clamping. On one hand, the metal plate can improve a strength of the protective frame, and on the other hand, the metal plate can enhance an aesthetics and fun of the water cup.

In summary, the present application includes at least one of the following beneficial technical effects.

1. By providing the base, the cup body, the cup lid, the sliding ring, the protective frame, the linkage rod, the tension spring, the limiting groove, the limiting block, and the lifting assembly, when the water cup is placed outdoors, the lifting assembly can be utilized to drive the plurality of limiting blocks to lift and lower simultaneously, so that the limiting blocks will detach from the limiting grooves. At this time, the tension spring pulls the protective frame, the sliding ring descends and drives the protective frame to rotate, causing the plurality of protective frames to simultaneously rotate and tilt on the side wall of the sliding ring. At this time, the lowest end of the protective frame is lower than the base, utilizing the protective frame to support the water cup. The protective frame can increase the support area of the water cup, thereby allowing the water cup to be stably placed on outdoor terrains and adapt to different outdoor terrains, the protective frame can not only protect the cup body but also support the cup body, reducing the occurrence of damage to the water cup and improving the functionality of the water cup.
2. By providing the button, the guiding column, the protrusion, the rotating block, the limiting column, the first reset spring, and the second reset spring, when the protective frames are needed to support the water cup, the button is pressed and slides along the height direction of the base on the guiding column. When the button slides, the plurality of protrusions are driven to slide, and the protrusion abuts against the first end of the rotating block, which drives the rotating block to rotate inside the base. The rotating block drives the limiting block to slide towards the bottom wall of the base on the limiting column, the limiting block gradually retracts into the base, and can quickly detach from the limiting groove. When the button is released, the reset element can drive the button and the limiting block to reset, the operation is convenient and fast.

3. By providing the installation block, the lifting ring, the sliding groove, the sliding rod, the connecting rod, the connecting groove, the locking block, the locking groove, and the locking spring, pressing the sliding rod drives the sliding rod to slide in the sliding groove at the same time, causing two sliding rods to approach each other, and then driving two connecting rods to approach each other in the connecting groove. The connecting rod drives the locking block and the locking groove to detach from each other, at this time, the installation block can be disassembled from the sliding ring, and the lifting ring can be used separately to improve the functionality of the water cup.

DETAILED DESCRIPTION

The present application will be further described in detail below with reference to FIGS. 1-5.

Figure 1:
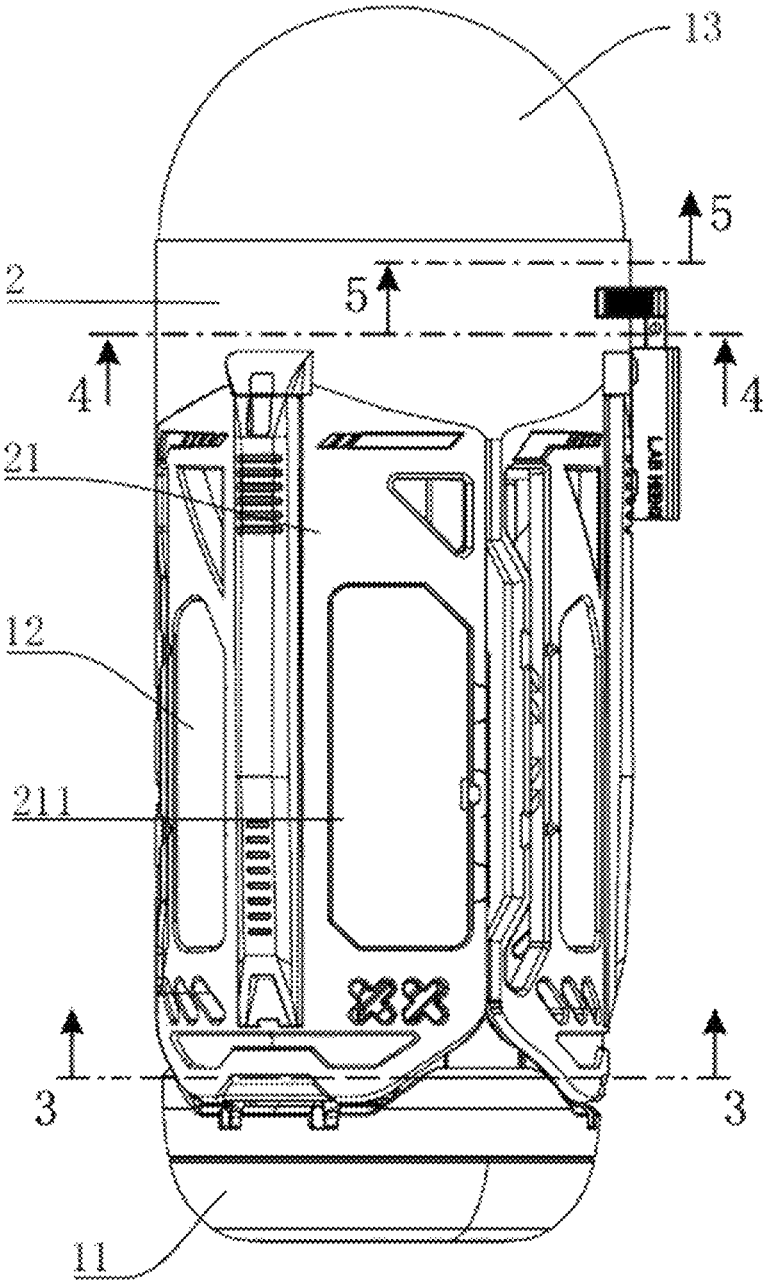
FIG. 1 is a schematic view of an outdoor water cup according to an embodiment of the present application.
Figure 2:
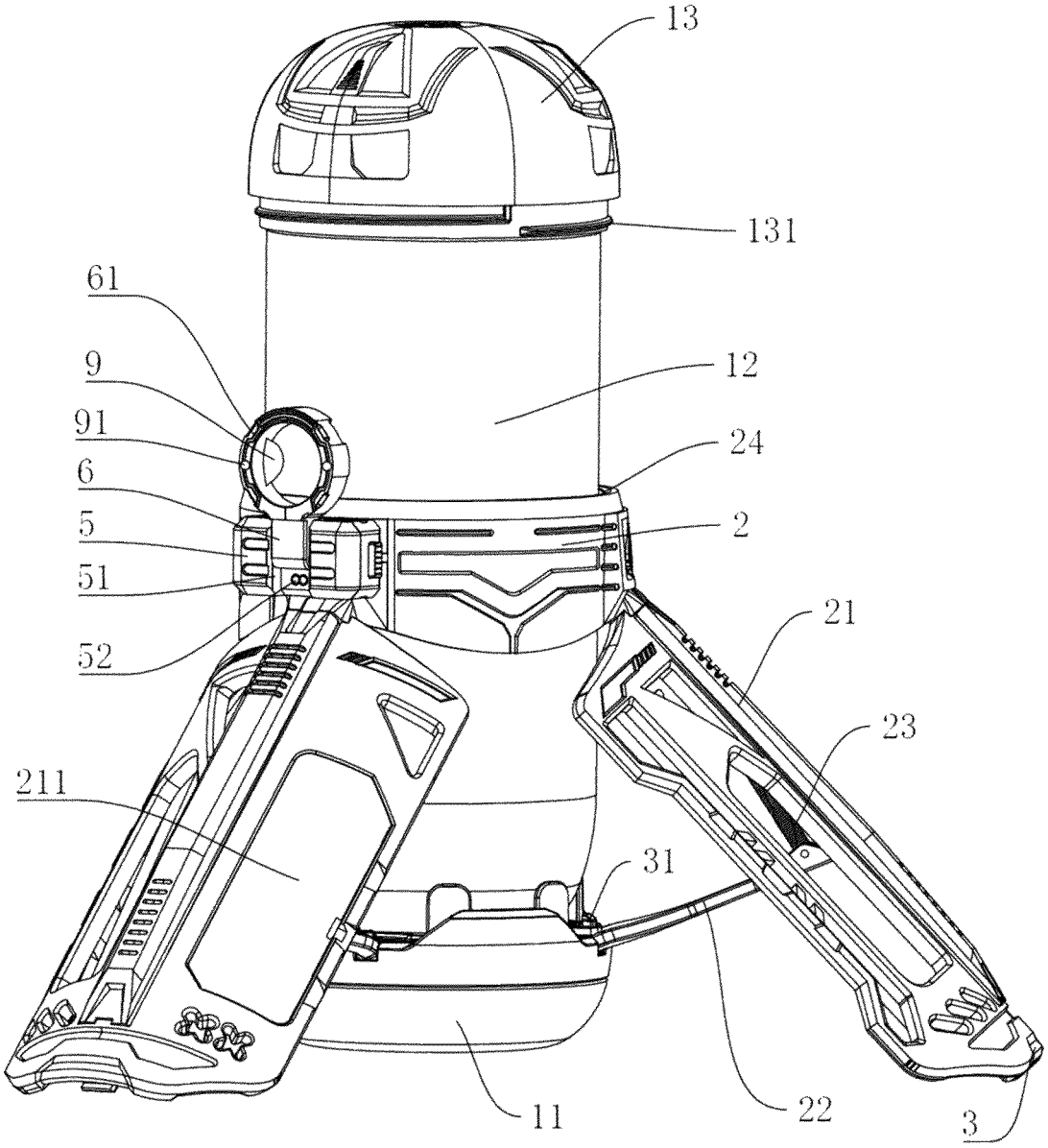
FIG. 2 is a schematic view of the outdoor water cup according to the embodiment of the present application.

The embodiment of the present application discloses an outdoor water cup. Referring to FIGS. 1 and 2, the outdoor water cup includes a base 11, a cup body 12 and a cup lid 13, the cup body 12 is located on the base 11, and the cup lid 13 is located on the cup body 12. A sliding ring 2 is slidably provided on the cup body 12, and the sliding ring 2 is adapted to the cup body 12, an inner wall of the sliding ring 2 is in contact with an outer wall of the cup body 12. A plurality of protective frames 21 are rotatably provided on a side wall of the sliding ring 2, and in this embodiment, there are three symmetrically provided protective frames 21. A surface of the protective frame 21 is defined with a limiting groove 3, and a plurality of limiting blocks 31 configured for lifting and lowering are provided on the base 11. When the water cup is in use, the limiting block 31 is inserted into the limiting groove 3, and the limiting block 31 abuts against the protective frame 21, so that the protective frame 21 is vertically between the sliding ring 2 and the base 11, the protective frame 21 is also located around the cup body 12, and the plurality of protective frames 21 form a circle to protect the cup body 12, reducing a situation of damage to the cup body 12 during use.

Figure 3:
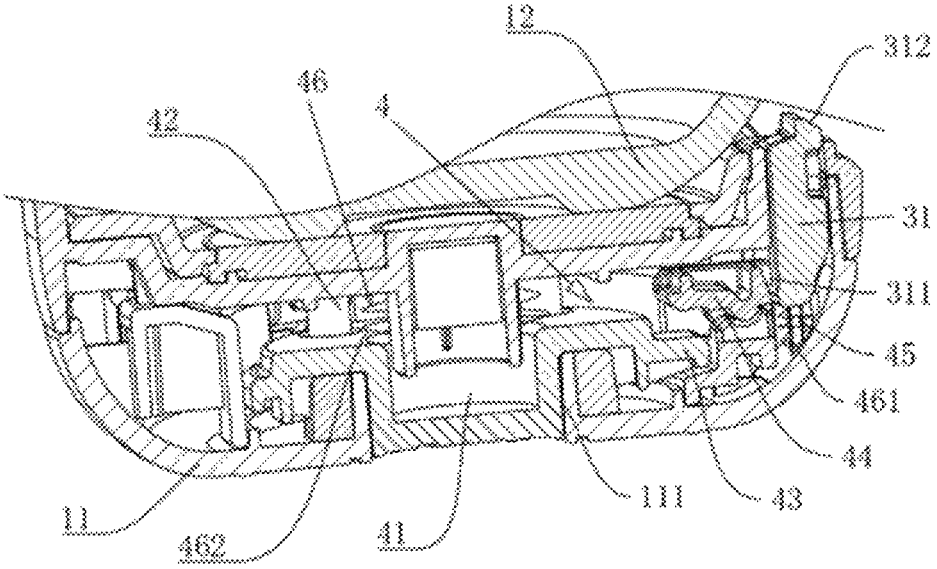
FIG. 3 is a schematic view used to show a lifting assembly according to the embodiment of the present application.

Referring to FIGS. 2 and 3, a linkage rod 22 is provided between the protective frame 21 and the base 11, a first end of the linkage rod 22 is hinged to the protective frame 21, and a second end of the linkage rod 22 is hinged to the base 11. A tension spring 23 is provided on the linkage rod 22, a first end of the tension spring 23 is connected to the linkage rod 22, and a second end of the tension spring 23 is connected to the protective frame 21. A lifting assembly 4 is provided on the base 11, when the water cup is placed outdoors, the lifting assembly 4 can be utilized to drive the plurality of limiting blocks 31 to descend simultaneously, causing the limiting block 31 to slide into the base 11, the limiting block 31 will detach from the limiting groove 3, at this time, the tension spring 23 pulls the protective frame 21, and the second end of the linkage rod 22 rotates with the base 11, the first end of the linkage rod 22 rotates with the protective frame 21, and the tension spring contracts to pull the sliding ring 2 to slide on the cup body 12 towards a direction of the base 11, the sliding ring 2 descends and drives the protective frame 21 to rotate, causing the plurality of protective frames 21 to simultaneously rotate and tilt on the side wall of the sliding ring 2. At this time, a lowest end of the protective frame 21 is lower than the base 11, utilizing the protective frame 21 to support the water cup, the protective frame 21 can increase a support area of the water cup, thereby allowing the water cup to be stably placed on outdoor terrains and adapt to different outdoor terrains.

Referring to FIGS. 2 and 3, the lifting assembly 4 includes a button 41, a guiding column 42, a protrusion 43, a rotating block 44, a limiting column 45 and a reset element 46, the limiting column 45 is fixedly provided inside the base 11, and a length direction of the limiting column 45 is provided along a height direction of the base 11, the limiting block 31 is slidably provided on the limiting column 45. A plurality of the guiding columns 42 are fixedly provided inside the base 11, and a length direction of the guiding column 42 is provided along the height direction of the base 11, a lower surface of the base 11 is defined with a driving groove 111, and the button 41 is slidably provided on the guiding column 42 and penetrates the driving groove 111. The protrusion 43 is integrated on an end wall of the button 41, and the rotating block 44 is rotatably provided inside the base 11, the protrusion 43 is located directly below the rotating block 44. The protrusion 43 is configured to abut against a first end of the rotating block 44, and the limiting block 31 is defined with a contacting groove 311 for inserting and abutting against a second of the rotating block 44. The reset element 46 includes a first reset spring 461 and a second reset spring 462, the first reset spring 461 is sleeved on the limiting column 45 and abuts against the limiting block 31, the second reset spring 462 is fixedly provided on a top wall of the base 11 and abuts against the button 41, a surface of the limiting block 31 is inclined and defined with a first guiding surface 312. When the protective frames 21 are needed to support the water cup, the button 41 is pressed and slides along the height direction of the base 11 on the guiding column 42. When the button 41 slides, a plurality of protrusions 43 are driven to slide, the protrusion 43 abuts against the first end of the rotating block 44, which drives the rotating block 44 to rotate inside the base 11, the rotating block 44 continues to rotate until the rotating block 44 is inserted into the contacting groove 311 and contacts an inner wall of the contacting groove 311. The rotating block 44 presses the contacting groove 311 with a contact force, which drives the limiting block 31 to slide towards a bottom wall of the base 11 on the limiting column 45, the limiting block 31 gradually retracts into the base 11, and the limiting block 31 and the limiting groove 3 can be quickly detached from each other. When the protective frame 21 is not needed to support the cup body 12, press the protective frame 21 to bring the protective frame 21 closer to the cup body 12, the protective frame 21 can abut against the first guiding surface 312, driving the limiting block 31 to automatically retract into the base 11. The protective frame 21 is in a vertical state, and the limiting block 31 is aligned with the limiting groove 3, the first reset spring 461 drives the limiting block 31 to slide away from the bottom wall of the base 11, and the limiting block 31 slides out of the base 11, the second reset spring 462 drives the button 41 to slide towards the bottom wall of the base 11, so that the button 41 is located in the driving groove 111 at a bottom end of the base 11. Quickly insert the limiting block 31 into the limiting groove 3, and reset the button 41.

Referring to FIGS. 1 and 2, an inner wall of the cup lid 13 is in contact with a cup lip of the cup body 12, and an outer wall of the cup lid 13 is integrally defined with an external thread 131, the inner wall of the sliding ring 2 is integrally defined with an internal thread 24, and the external thread 131 is threaded with the internal thread 24. When the protective frames 21 are used to support the water cup, a user needs to first rotate the cup lid 13 to separate the external thread 131 and the internal thread 24 from each other, before the protective frame 21 can be rotated. Utilizing a combination of the external thread 131 and the internal thread 24, the protective frame 21 can be locked to reduce accidental contact, at the same time, the combination of the external thread 131 and the internal thread 24 facilitates a fixation of the cup lid 13.

Referring to FIG. 2, an installation block 5 is provided on the sliding ring 2, and a surface of the installation block 5 is defined with an installation groove 51. A connecting block 6 is rotatably provided inside the installation groove 51, and the connecting block 6 is connected to a lifting ring 61, the lifting ring 61 is a mountaineering buckle, the lifting ring 61 facilitates an user to lift the water cup, and the lifting ring 61 can also be attached to other tools, which is convenient to hang the water cup and improve the functionality of the water cup. A set of adsorption elements 52 configured to adsorb to the connecting block 6 are provided on an inner wall of the installation groove 51, the adsorption element 52 is a magnet, and the connecting block 6 is made of a iron material, when the lifting ring 61 is not needed, the connecting block 6 can be rotated to adsorb to the adsorption elements 52 on the inner wall of the installation groove 51, so that the lifting ring 61 is in a vertical state, reducing a space occupied by the water cup and improving a beauty of the water cup.

Figure 4:
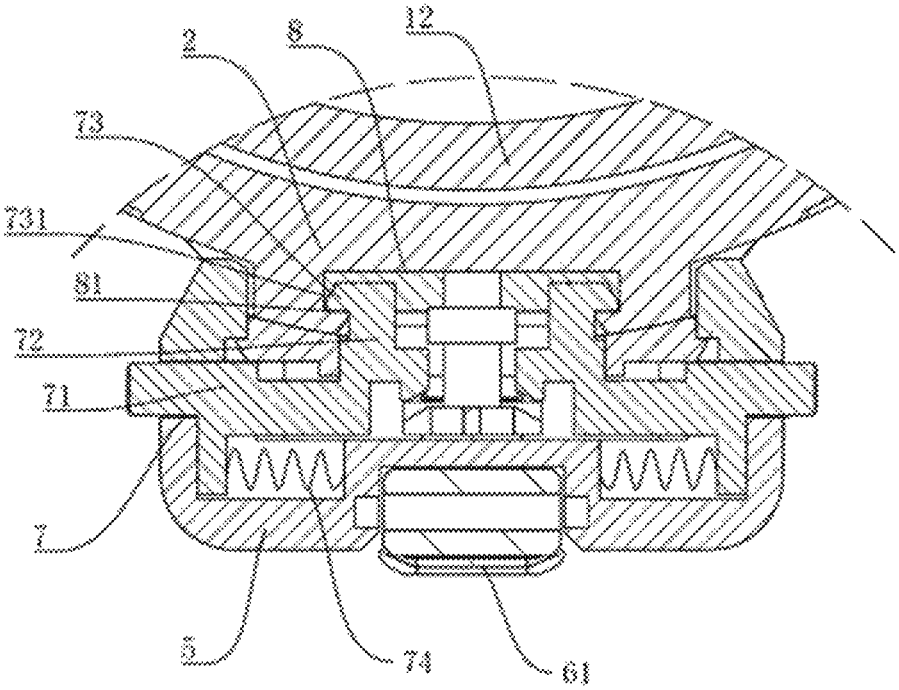
FIG. 4 is a schematic view used to show a connection relationship between an installation block and a sliding ring according to the embodiment of the present application.
Figure 5:
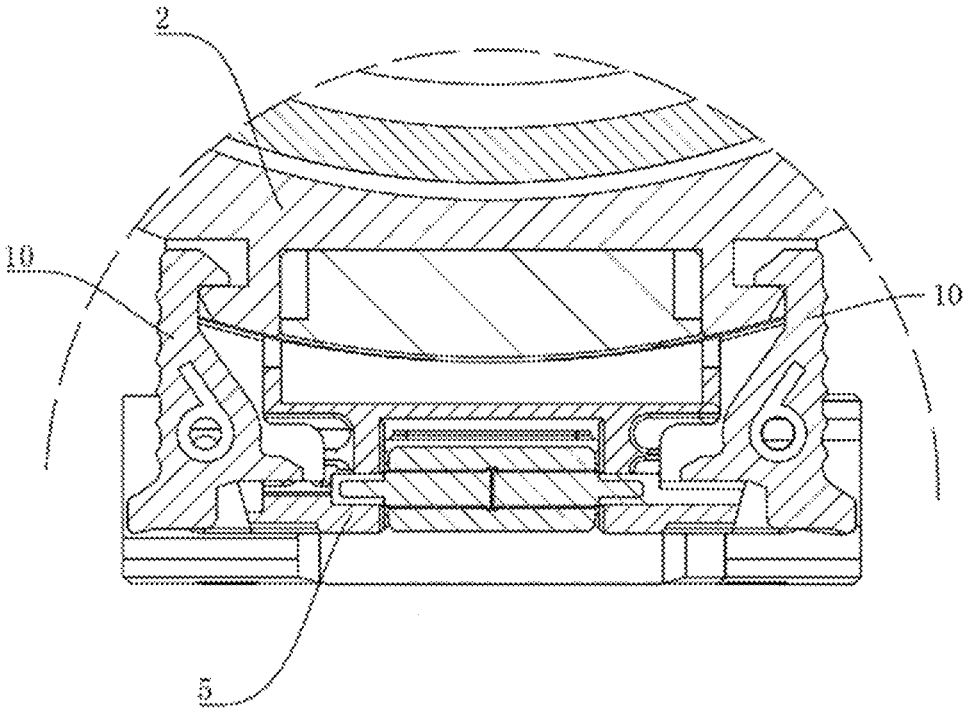
FIG. 5 is a schematic view used to show the connection relationship between the installation block and the sliding ring according to the embodiment of the present application.

Referring to FIGS. 2 and 4, an inner wall of the lifting ring 61 is provided with a bottle opener 9. Two ends of the installation block 5 are symmetrically defined with a sliding groove 7, and a length direction of the sliding groove 7 is provided along a length direction of the installation block 5, a sliding rod 71 is provided inside the sliding groove 7, and a locking spring 74 is provided inside the sliding groove 7 to abut against the sliding rod 71, the locking spring 74 is configured to drive the sliding rod 71 to slide away from the sliding groove 7. The sliding rod 71 is connected to a connecting rod 72, and a length direction of the connecting rod 72 is perpendicular to a length direction of the sliding rod 71, the sliding ring 2 is defined with a connecting groove 8 for inserting the connecting rod 72. A locking block 73 is integrated on the connecting rod 72, and an inner wall of the connecting groove 8 is defined with a locking groove 81 for inserting and abutting against the locking block 73, an end wall of the locking block 73 is inclined and defined with a second guiding surface 731. Pressing the sliding rod 71 drives the sliding rod 71 to slide in the sliding groove 7 at the same time, causing two sliding rods 71 to approach each other, and then driving two connecting rods 72 to approach each other in the connecting groove 8. The connecting rod 72 drives the locking block 73 and the locking groove 81 to detach from each other, at this time, the installation block 5 can be disassembled from the sliding ring 2, using the lifting ring 61 separately. The lifting ring 61 and the bottle opener 9 can be utilized to open a bottle with a bottle cap. When installing the lifting ring 61, the connecting rod 72 is directly inserted into the connecting groove 8, the second guiding surface 731 will abut against the sliding ring 2, and a force on the second guiding surface 731 will drive the sliding rod 71 to slide into the sliding groove 7. When the locking block 73 and the locking groove 81 are flush with each other, the locking spring 74 will drive the sliding rod 71 to slide away from the sliding groove 7, and automatically drive the locking block 73 to be inserted into the locking groove 81, the operation is convenient and fast. Referring to FIG. 5, a pinch button 10 can further be provided at two ends of the installation block 5 through a torsional spring, a top of the pinch button 10 is inserted at two ends of the sliding ring 2, pressing the pinch button 10 drives the pinch button 10 to rotate, which can detach the pinch button 10 from the sliding ring 2 and quickly disassemble the installation block 5 from the sliding ring 2.

Referring to FIGS. 1 and 2, a metal plate 211 is provided on the protective frame 21, and the metal plate 211 is detachably connected to the protective frame 21 through clamping, the metal plate 211 is customized by DIY, and then the metal plate 211 and the protective frame 21 are connected to each other through clamping. On one hand, the metal plate 211 can improve a strength of the protective frame 21, and on the other hand, the metal plate 211 can enhance an aesthetics and fun of the water cup. An outer wall of the lifting ring 61 is provided with a magnetic element 91, the magnetic element 91 is the magnet, the magnetic element 91 can remove the lifting ring 61 and attach the lifting ring 61 to the metal plate 211 on the refrigerator or protective frame 21, which is convenient to use the lifting ring 61 separately.

An implementation principle of the outdoor water cup in the embodiment of the present application is as follows. When the water cup is placed outdoors, press the button 41 to drive the protrusion 43 to abut against the first end of the rotating block 44, the rotating block 44 rotates and the second end of the rotating block 44 then presses the contacting groove 311 through the contact force, driving the limiting block 31 to slide towards the bottom wall of the base 11 on the limiting column 45, the limiting block 31 will detach from the limiting groove 3. At this time, the tension spring 23 pulls the protective frame 21, and the tension spring contracts to pull the sliding ring 2 to slide towards the base 11 on the cup body 12, the sliding ring 2 descends and drives the protective frame 21 and the linkage rod 22 to rotate, causing the plurality of protective frames 21 to simultaneously rotate and tilt on the side wall of sliding ring 2. At this time, the lowest end of the protective frame 21 is lower than the base 11, utilizing the protective frame 21 to support the water cup, the protective frame 21 can increase the support area of the water cup, thereby allowing the water cup to be stably placed on outdoor terrains and adapt to different outdoor terrain. The protective frame 21 can not only protect the cup body 12 but also support the cup body, reducing the occurrence of damage to the water cup and improving the functionality of the water cup.

The above are the preferred embodiments of the present application, which are not intended to limit a protection scope of the present application. Therefore, all equivalent changes made according to the structure, shape and principle of the present application should be covered within the protection scope of the present application.

LISTING OF REFERENCE SIGNS

1. base
111. driving groove

12. cup body
13. cup lid
131. external thread
2. sliding ring
21. protective frame
211. metal plate
22. linkage rod
23. tension spring
24. internal thread
3. limiting groove
31. limiting block
311. contacting groove
312. first guiding surface
4. lifting assembly
41. button
42. guiding column
43. protrusion
44. rotating block
45. limiting column
46. reset element
461. first reset spring
462. second reset spring
5. installation block
51. installation groove
52. adsorption element
6. connecting block
61. lifting ring
7. sliding groove
71. sliding rod
72. connecting rod
73. locking block
731. second guiding surface
74. locking spring
8. connecting groove
9. bottle opener
91. magnetic element
10. pinch button

What is claimed is:

1. An outdoor water cup, comprising a base, a cup body and a cup lid, wherein the cup body is located on the base, the cup lid is located on the cup body, a sliding ring is slidably provided on the cup body, a plurality of protective frames are rotatably provided on a side wall of the sliding ring, a linkage rod is provided between one of the plurality of protective frames and the base, a first end of the linkage rod is hinged to the one of the plurality of protective frames, a second end of the linkage rod is hinged to the base, a tension spring is provided on the linkage rod, a first end of the tension spring is connected to the linkage rod, a second end of the tension spring is connected to the protective frame, a surface of the protective frame is defined with a limiting groove, a plurality of limiting blocks configured for lifting and lowering are provided on the base, one of the plurality of limiting blocks is configured to inserted into the limiting groove to abut against the limiting groove, and a lifting assembly is provided on the base and configured to drive the plurality of limiting blocks to lift and lower simultaneously.

2. The outdoor water cup according to claim 1, wherein the lifting assembly comprises a button, a plurality of guiding column, a protrusion, a rotating block, a limiting column and a reset element, the limiting column is fixedly provided inside the base, the one of the plurality of limiting blocks is slidably provided on the limiting column, the plurality of guiding columns are fixedly provided inside the base, a lower surface of the base is defined with a driving groove, the button is slidably provided on one of the plurality of guiding columns and penetrates the driving groove, the protrusion is integrated on an end wall of the button, the rotating block is rotatably provided inside the base, the protrusion is configured to abut against a first end of the rotating block, the one of the plurality of limiting blocks is defined with a contacting groove for inserting and abutting against a second end of the rotating block, the reset element is located inside the base, and the reset element is configured to drive the button and the one of the plurality of limiting blocks to reset.

3. The outdoor water cup according to claim 2, wherein the reset element comprises a first reset spring and a second reset spring, the first reset spring is sleeved on the limiting column and abuts against the one of the plurality of limiting blocks, the second reset spring is provided on a top wall of the base and abuts against the button, the second reset spring is configured to drive the button to be located in the driving groove, a surface of the one of the plurality of limiting blocks is inclined and defined with a first guiding surface, and the one of the plurality of protective frames is configured to abut against the first guiding surface.

4. The outdoor water cup according to claim 2, wherein an inner wall of the cup lid is in contact with a cup lip of the cup body, an outer wall of the cup lid is defined with an external thread, an inner wall of the sliding ring is defined with an internal thread, and the external thread is threaded with the internal thread.

5. The outdoor water cup according to claim 1, wherein an installation block is provided on the sliding ring, a surface of the installation block is defined with an installation groove, a connecting block is rotatably provided inside the installation groove, the connecting block is connected to a lifting ring, a set of adsorption elements configured to adsorb to the connecting block are provided on an inner wall of the installation groove, and the installation block is detachably connected to the sliding ring.

6. The outdoor water cup according to claim 5, wherein two ends of the installation block are symmetrically defined with a sliding groove, a sliding rod is provided inside the sliding groove, the sliding rod is connected to a connecting rod, the sliding ring is defined with a connecting groove configured for inserting the connecting rod, a locking block is integrated on the connecting rod, an inner wall of the connecting groove is defined with a locking groove configured for inserting and abutting against the locking block, a locking spring is provided inside the sliding groove to abut against the sliding rod, the locking spring is configured to drive the sliding rod to slide away from the sliding groove, and an end wall of the locking block is inclined and defined with a second guiding surface.

7. The outdoor water cup according to claim 5, wherein the lifting ring is a mountaineering buckle.

8. The outdoor water cup according to claim 5, wherein an inner wall of the lifting ring is provided with a bottle opener, and an outer wall of the lifting ring is provided with a magnetic element.

9. The outdoor water cup according to claim 1, wherein a metal plate is provided on the one of the plurality of protective frames, and the metal plate is detachably connected to the one of the plurality of protective frames through clamping.

* * * * *